US009380854B2

(12) United States Patent
Hamra

(10) Patent No.: US 9,380,854 B2
(45) Date of Patent: Jul. 5, 2016

(54) LATCH AND CARRY DETACHABLE MESSENGER BAG AND STRAP ASSEMBLY FOR PERSONAL ELECTRONIC DEVICES

(71) Applicant: Andrew Hamra, Austin, TX (US)

(72) Inventor: Andrew Hamra, Austin, TX (US)

(73) Assignee: RED STREET VENTURES LLC, Austin, TX (US)

( * ) Notice: Subject to any disclaimer, the term of this patent is extended or adjusted under 35 U.S.C. 154(b) by 82 days.

(21) Appl. No.: 14/108,289

(22) Filed: Dec. 16, 2013

(65) Prior Publication Data

US 2014/0166658 A1 Jun. 19, 2014

Related U.S. Application Data

(60) Provisional application No. 61/737,331, filed on Dec. 14, 2012.

(51) Int. Cl.

| | |
|---|---|
| ***A45F 5/00*** | (2006.01) |
| ***A45C 11/00*** | (2006.01) |
| ***A45F 3/14*** | (2006.01) |
| *A45C 13/10* | (2006.01) |

(52) U.S. Cl.

CPC . *A45F 5/00* (2013.01); *A45C 11/00* (2013.01); *A45F 3/14* (2013.01); *A45C 13/103* (2013.01); *A45C 2011/003* (2013.01); *A45C 2200/10* (2013.01); *A45C 2200/15* (2013.01); *A45F 2003/142* (2013.01); *A45F 2005/006* (2013.01); *A45F 2200/0525* (2013.01)

(58) Field of Classification Search

CPC ..... A45C 2200/10; A45C 2011/003; A45F 2200/0525

USPC ..... 224/665, 666, 677, 162, 930; 361/679.59; 24/690–693, 309.1, 316.7, 24/339, 304, 30

See application file for complete search history.

(56) References Cited

U.S. PATENT DOCUMENTS

| | | | | |
|---|---|---|---|---|
| 5,639,004 | A * | 6/1997 | Carlton et al. | 224/579 |
| 5,887,777 | A | 3/1999 | Myles et al. | |
| 6,163,450 | A | 12/2000 | Kim | |
| 6,176,403 | B1 * | 1/2001 | Svare | A45F 5/00 206/315.1 |
| 6,641,011 | B1 * | 11/2003 | Kahn | A45F 5/02 224/269 |
| 6,763,942 | B1 | 7/2004 | Yeh | |

(Continued)

OTHER PUBLICATIONS

Hamra, International Patent Application No. PCT/US2013/075507, International Search Report dated Apr. 23, 2014.

*Primary Examiner* — Adam Waggenspack
(74) *Attorney, Agent, or Firm* — Kramer Amado PC

(57) ABSTRACT

A carrying case assembly for portable electronic devices includes a carrying case that has: an exterior casing that creates a compartment for receiving a portable electronic device; means for securing the portable electronic device within the compartment; and a first component of an interlocking mechanism attached to a surface of the exterior casing and utilized to hang the carrying case on a user wearable strap configured with a second component of the interlocking mechanism. The assembly further includes a holding latch having: (i) a first connecting section that securely attaches the holding latch to the user wearable strap; and (ii) a second connecting section serving as the second component of the interlocking mechanism, which receives the first component attached to the surface of the carrying case and enables the carrying case to be fixably and removably attached to the user wearable device via the holding latch.

34 Claims, 13 Drawing Sheets

(56) References Cited

U.S. PATENT DOCUMENTS

| | | | | |
|---|---|---|---|---|
| 6,905,051 | B2 * | 6/2005 | Chee | A45F 5/00 224/197 |
| 8,132,670 | B1 * | 3/2012 | Chen | 206/320 |
| 8,752,740 | B2 * | 6/2014 | Morgan et al. | 224/222 |
| 2003/0164389 | A1 * | 9/2003 | Byers | A44C 5/0007 224/221 |
| 2005/0072819 | A1 * | 4/2005 | Maldonado | A45F 5/004 224/162 |
| 2005/0092791 | A1 * | 5/2005 | Labarca | A45F 5/02 224/269 |
| 2011/0031290 | A1 * | 2/2011 | Remo | A45F 5/00 224/222 |
| 2012/0018266 | A1 | 1/2012 | Ziv et al. | |
| 2012/0018609 | A1 | 1/2012 | Rowzee et al. | |
| 2012/0024917 | A1 * | 2/2012 | Case et al. | 224/259 |
| 2012/0074184 | A1 * | 3/2012 | Morgan | A45F 5/00 224/222 |
| 2012/0087100 | A1 | 4/2012 | Ku | |
| 2012/0091025 | A1 * | 4/2012 | Wyner et al. | 206/523 |
| 2012/0104059 | A1 * | 5/2012 | Yen | 224/218 |

* cited by examiner

LATCH AND CARRY DETACHABLE MESSENGER BAG AND STRAP ASSEMBLY FOR PERSONAL ELECTRONIC DEVICES

PRIORITY CLAIM

The present application claims the benefit of the filing date of U.S. Provisional Patent Application No. 61/737,331, filed on Dec. 14, 2012, the content of which is incorporated herein by reference.

BACKGROUND

1. Technical Field

The present disclosure generally relates to a carrying case assembly and in particular to a carrying case designed for portable electronic devices.

2. Description of the Related Art

Backpacks and other personal carry items, such as messenger bags, purses and handbags, are traditionally designed to store personal items on the interior of the bag, where the stored items can only be accessed by opening the carrying and removing the item therefrom. Presently, there are no functional carrying bags that allow for ready detachable use of an electronic device requiring user manipulation to operate specific interfacing functions. All existing carrying bags require the user to first remove the electronic device from the carrier or have the electronic device stay contained within the carrier as the device is being utilized for user interfacing.

SUMMARY

The described embodiments provide a latch and carry detachable carrying case and a carrying case assembly for electronic devices. According to one embodiment, the carrying case assembly includes a specially designed carrying case. The carrying case includes: an exterior casing that creates a compartment for receiving a portable electronic device that is inserted in the carrying case for storage and use therein; and means for securing the portable electronic device within the compartment when the electronic device has been inserted in the compartment. The carrying case also includes a first component of an interlocking mechanism attached to a surface of the exterior casing and utilized to hang the carrying case on a user wearable strap configured with a second component of the interlocking mechanism.

In one embodiment, the carrying case further includes: a screen access surface within the exterior casing which provides viewable access to a screen of the inserted portable electronic device. The screen access surface comprises a material that enables the screen access surface to transfer tactile inputs on an exterior surface of the material and transfer the tactile input to the screen of the portable electronic device and control the electronic device when the portable electronic device has a touch screen interface. In at least one implementation, the first component of the interlocking mechanism is located at a top of the carrying case with an orientation that enables the screen of the inserted electronic portable device to be oriented towards a body of a user wearing the carrying case assembly when the first component is interlocked with the second component.

In one or more embodiments, the carrying case also includes a cover flap that attaches to a perimeter of the screen access surface and is movable into one of (i) a closed position that covers and prevents access to the screen of the inserted portable electronic device and (ii) an open position that exposes the screen access surface. According to one aspect, the cover flap is one of: (a) affixed at one end to a perimeter surface of the carrying case by a permanent adhesive means; (b) stitched at the one end to the perimeter surface of the carrying case; and (c) a separate component from the carrying case that is removably attached to the perimeter of the screen access surface via one or more non-permanent adhesive means.

In one embodiment, a user interface device is embedded in an inner surface of the cover flap and is accessible when the cover flap is in the open position. A communication mechanism enables the user interface device to communicatively couple to the inserted portable electronic device, wherein the communication mechanism includes one or more of: (i) a wired connection extending from the cover flap to an interior of the compartment and having a connective end for insertion into the inserted portable electronic device; and (ii) a wireless connection that connects with the inserted portable electronic device via a created wireless channel following a pairing of the inserted portable electronic device with the user interface device.

According to one aspect, the carrying case assembly further includes a holding latch designed for attachment to a user wearable strap and having: (i) a first connecting section that securely attaches the holding latch to the user wearable strap; and (ii) a second connecting section serving as the second component of the interlocking mechanism, which receives the first component attached to the surface of the carrying case and enables the carrying case to be fixably and removably attached to the holding latch. The holding latch is made of a material having compressive and tensile strength that supports moveable hanging of the carrying case off the latch with the portable electronic device and other objects inserted in the carrying case. The holding latch can be permanently affixed at the first connection section to the user wearable strap or a separate, detachable item from the user wearable strap. When a separate component, the latch includes: a first segment that extends vertically downwards to slip into an inner section of the user wearable strap; a middle segment, connected to the first segment and extending downwards away from the connecting end with the first segment to provide an elongated section between the first segment and the middle segment having a width and length dimension that enables a secure connection to the user wearable strap; and a device connecting segment that connects to and extends from the middle segment at an angle that supports efficient interlocking of the first component on the device connecting segment and which is configured with specific dimensions to be the second component of the interlocking mechanism.

In one or more embodiments, the interlocking mechanism comprises a buckle and latch assembly, with one of the first component and the second component being the buckle and a next one of the first component and the second component being the latch.

According to one additional aspect of the disclosure, the user wearable strap, which is a component of the carrying case assembly comprises a strap that extends over at least one shoulder of a user wearing the carrying case assembly. The strap is sized to accommodate carrying at least the carrying case assembly, and the strap contains one or more pockets for insertion of one or more personal objects of the user.

The carrying case assembly further includes a folding flap having at least one segment that is extendable away from the carrying case to provide a pivot that enables the carrying case to stand in an upright orientation. In one embodiment, the folding flap is configured with multiple movable parts that collapse to present a flat assembly adjacent to a surface of the carrying cases when the carrying case is not in an upright position.

The above summary contains simplifications, generalizations and omissions of detail and is not intended as a comprehensive description of the claimed subject matter but, rather, is intended to provide a brief overview of some of the functionality associated therewith. Other systems, methods, functionality, features and advantages of the claimed subject matter will be or will become apparent to one with skill in the art upon examination of the following figures and detailed written description.

BRIEF DESCRIPTION OF THE DRAWINGS

The description of the illustrative embodiments can be read in conjunction with the accompanying figures. It will be appreciated that for simplicity and clarity of illustration, elements illustrated in the figures have not necessarily been drawn to scale. For example, the dimensions of some of the elements are exaggerated relative to other elements. Embodiments incorporating teachings of the present disclosure are shown and described with respect to the figures presented herein, in which.

DETAILED DESCRIPTION OF ILLUSTRATIVE EMBODIMENTS

Figure 1:
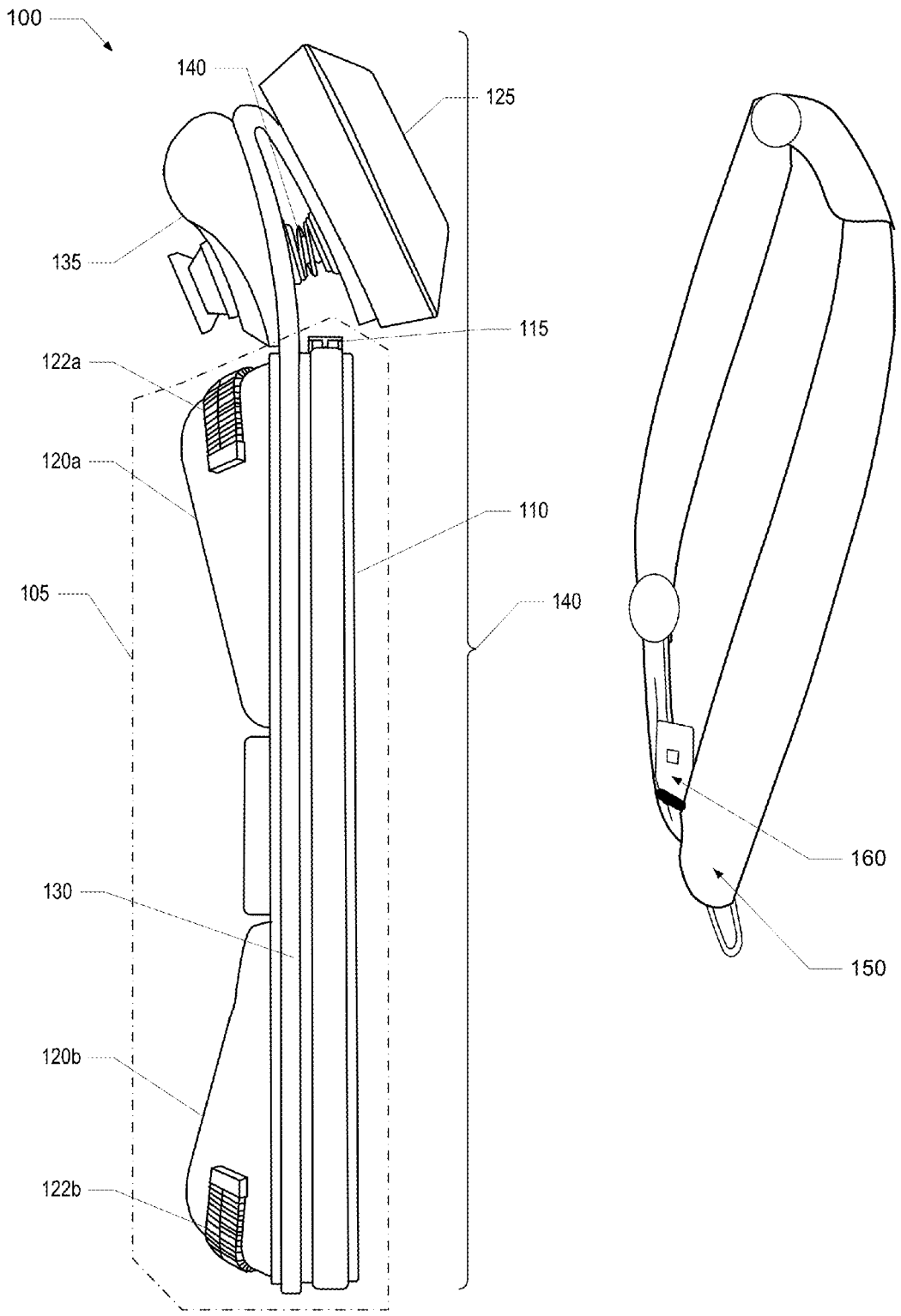
FIG. 1 illustrates a vertical side view of an example carrying case with attached first component of an interlocking device, in accordance with one embodiment.

Disclosed is a carrying case assembly for portable electronic devices. The assembly includes a carrying case that has: an exterior casing that creates a compartment for receiving a portable electronic device; means for securing the portable electronic device within the compartment; and a first component of an interlocking mechanism attached to a surface of the exterior casing and utilized to hang the carrying case on a user wearable strap configured with a second component of the interlocking mechanism. The assembly further includes a holding latch having: (i) a first connecting section that securely attaches the holding latch to the user wearable strap; and (ii) a second connecting section serving as the second component of the interlocking mechanism, which receives the first component attached to the surface of the carrying case and enables the carrying case to be fixably and removably attached to the user wearable device via the holding latch.

The following descriptions further provide one or more embodiments of a clip and carry detachable carrying case assembly for electronic devices that have a user-interfacing screen disposed in an exposed surface of the device. The terminology latch and carry refers to one embodiment of the carrying case assembly where the interlocking mechanism includes a first component that latches into the second component and provides a secure interlock of the components that enables the carrying case with electronic device inserted therein to be carried by the user hanging from the user wearable strap. Other embodiments that do not involve a latch and carry interlocking device are also presented herein.

In the following detailed description of exemplary embodiments of the disclosure, specific exemplary embodiments in which the disclosure may be practiced are described in sufficient detail to enable those skilled in the art to practice the disclosed embodiments. For example, specific details such as specific method orders, structures, elements, and connections have been presented herein. However, it is to be understood that the specific details presented need not be utilized to practice embodiments of the present disclosure. It is also to be understood that other embodiments may be utilized and that logical, architectural, programmatic, mechanical, electrical and other changes may be made without departing from general scope of the disclosure. The following detailed description is, therefore, not to be taken in a limiting sense, and the scope of the present disclosure is defined by the appended claims and equivalents thereof.

References within the specification to "one embodiment," "an embodiment," "embodiments", or "one or more embodiments" are intended to indicate that a particular feature, structure, or characteristic described in connection with the embodiment is included in at least one embodiment of the present disclosure. The appearance of such phrases in various places within the specification are not necessarily all referring to the same embodiment, nor are separate or alternative embodiments mutually exclusive of other embodiments. Further, various features are described which may be exhibited by some embodiments and not by others. Similarly, various requirements are described which may be requirements for some embodiments but not other embodiments.

It is understood that the use of specific component, device and/or parameter names and/or corresponding acronyms thereof, such as those of the executing utility, logic, and/or firmware described herein, are for example only and not meant to imply any limitations on the described embodiments. The embodiments may thus be described with different nomenclature and/or terminology utilized to describe the components, devices, parameters, methods and/or functions herein, without limitation. References to any specific protocol or proprietary name in describing one or more elements, features or concepts of the embodiments are provided solely as examples of one implementation, and such references do not limit the extension of the claimed embodiments to embodiments in which different element, feature, protocol, or concept names are utilized. Thus, each term utilized herein is to be given its broadest interpretation given the context in which that terms is utilized.

Further, those of ordinary skill in the art will appreciate that the physical components and basic configuration depicted in the various figures and described herein may vary. For example, the illustrative components of or associated with carrying case assembly 100 or carrying case 105 (FIGS. 1-4) are not intended to be exhaustive, but rather are representative to highlight components that can be utilized to implement various aspects of the present disclosure. For example, other structures and configurations may be used in addition to or in place of those depicted. The depicted examples do not convey or imply any architectural or other limitations with respect to the presently described embodiments and/or the general disclosure.

Within the descriptions of the different views of the figures, similar elements are provided similar names and reference numerals as those of the previous figure(s). The specific numerals assigned to the elements are provided solely to aid in the description and are not meant to imply any limitations (structural or functional or otherwise) on the described embodiment.

Figure 3A:
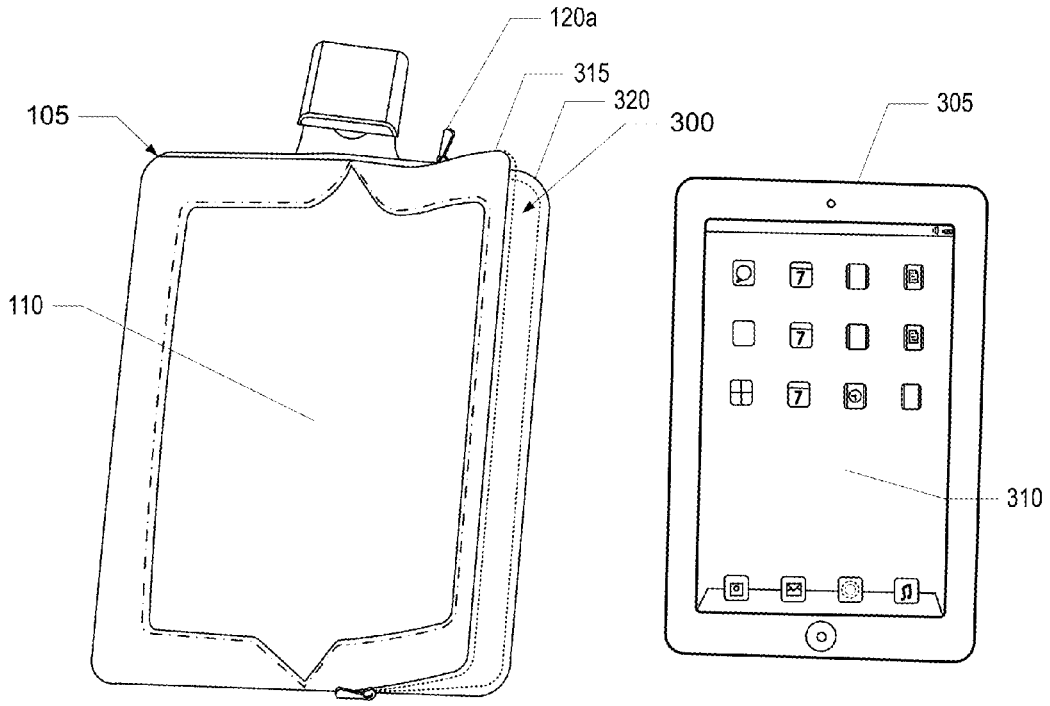
FIGS. 3A-3B illustrates the insertion of a portable electronic device into the interior compartment of the example carrying case, in accordance with one embodiment.
Figure 3B:
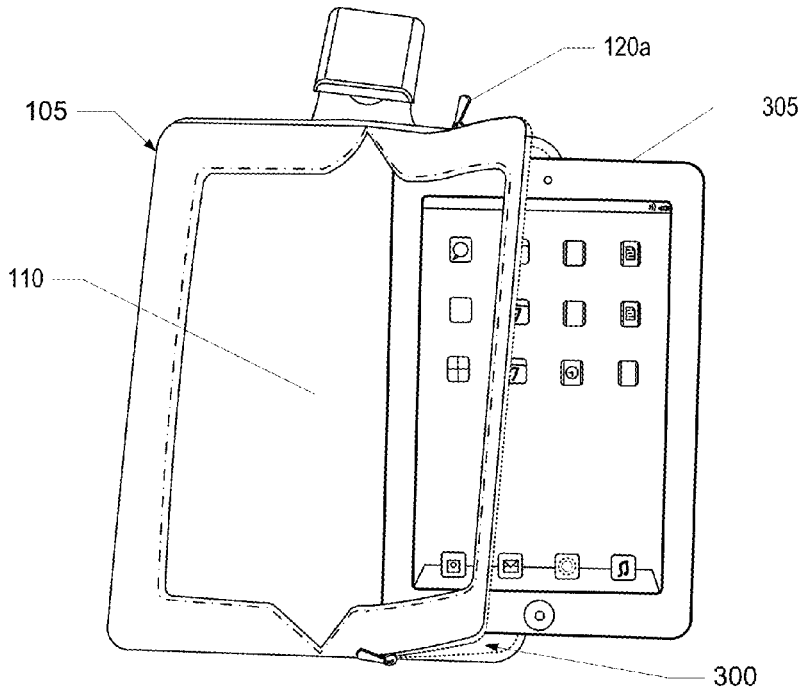
Figure 12:
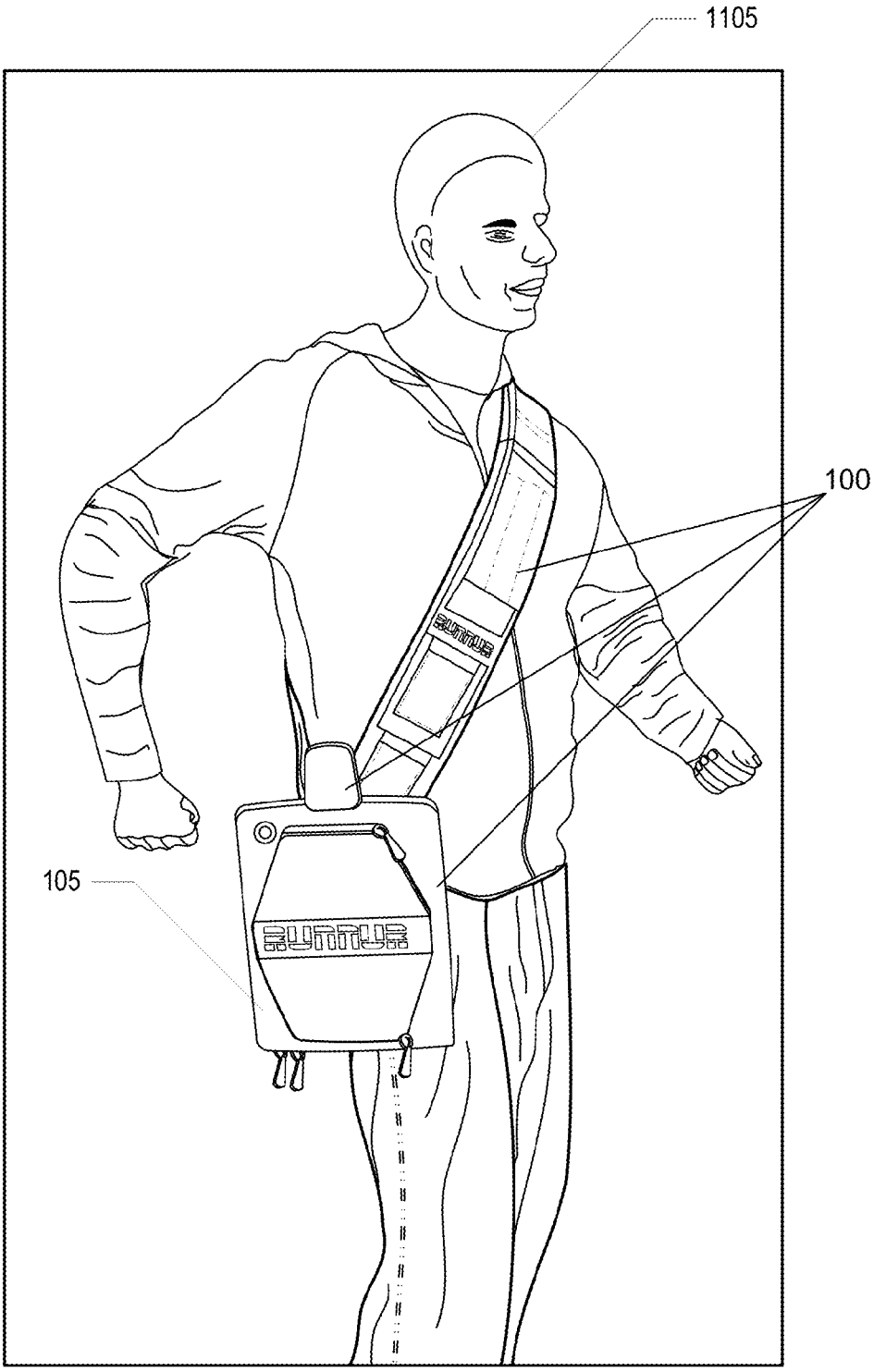
Figure 13:
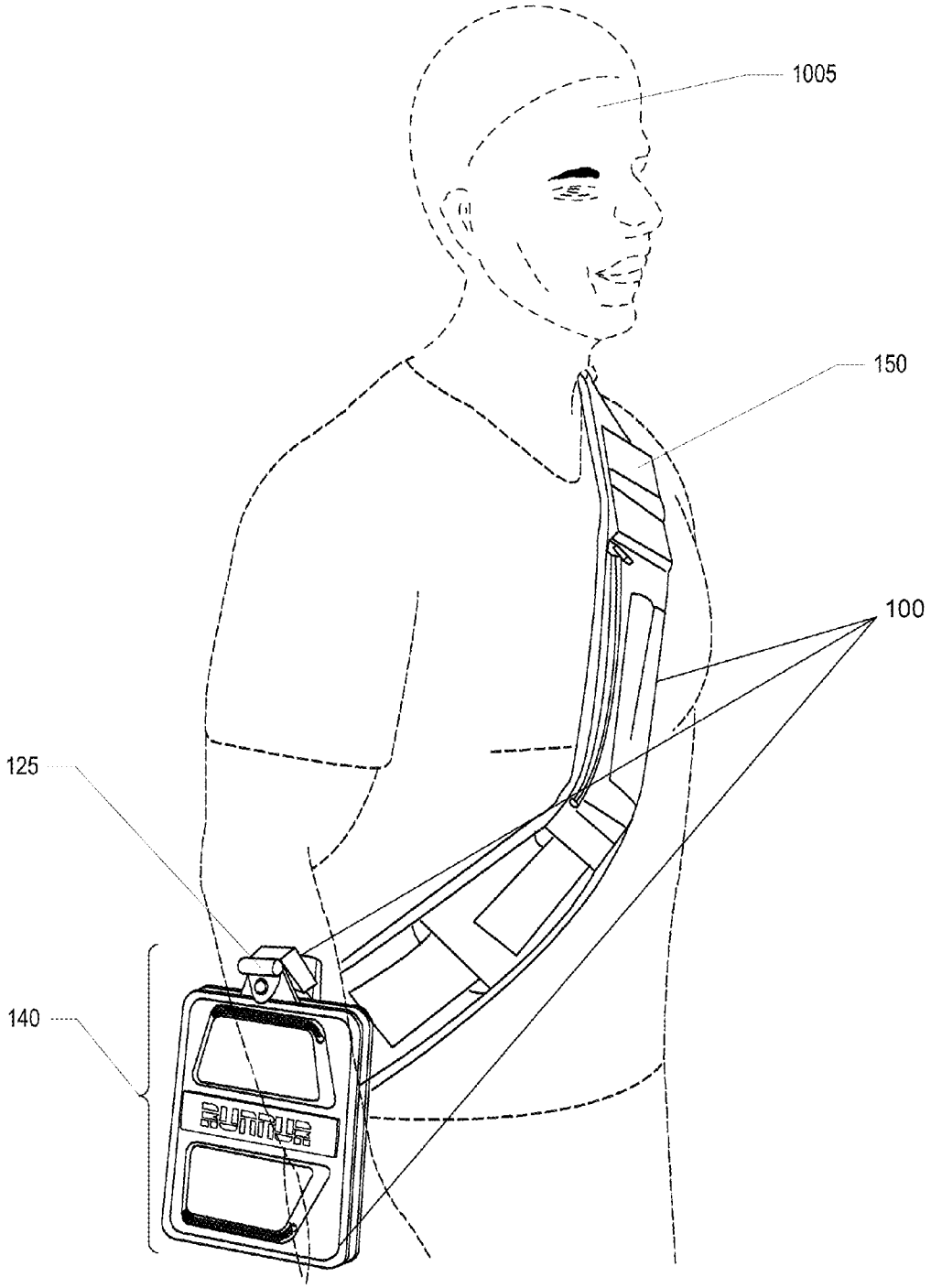
FIGS. 13 and 14 respectively illustrate portability of the example carrying case assembly including the carrying case interlocked with the wearable strap being worn by a user around the shoulders, in accordance with one embodiment and the wearable strap being worn by a user around the waist, in accordance with another embodiment.
Figure 14:
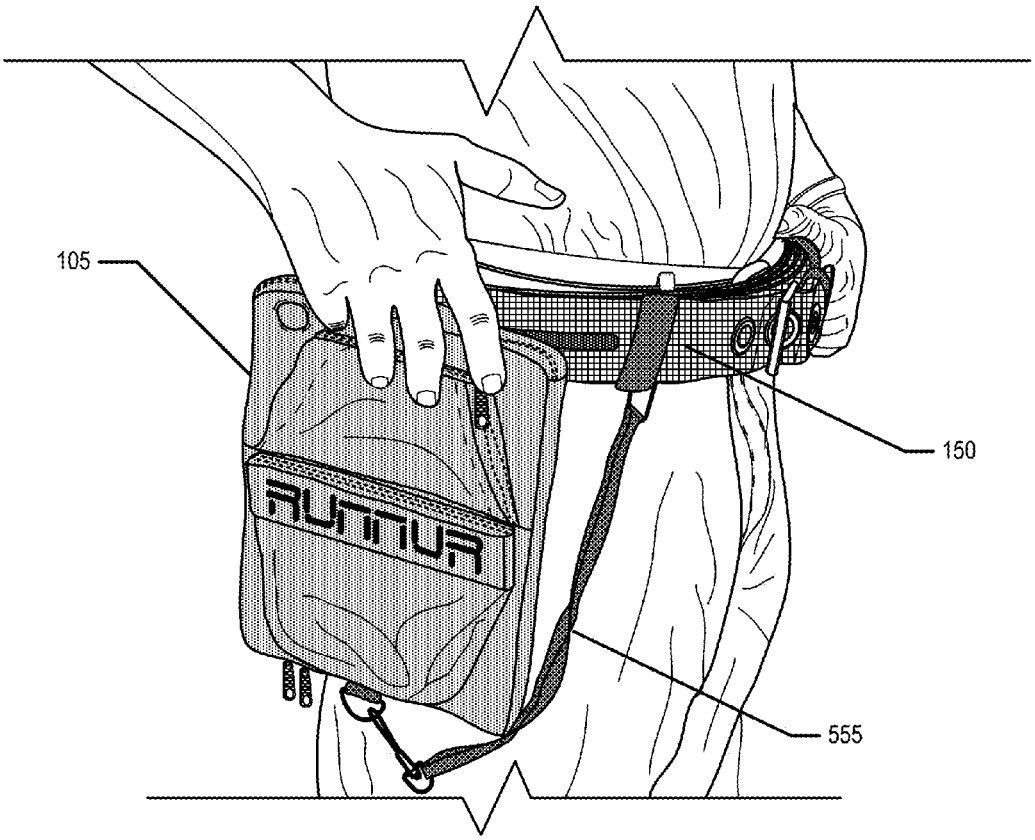

The disclosure generally provides various design and configuration features of a carrying case assembly 100 (FIGS. 12 and 13), which has as its primary components a carrying case 105, an interlocking mechanism (e.g., 800, FIG. 8) and a wearable strap 1100. The specific aspects of the illustrative embodiments are described below with reference to the figures. According to the general disclosure, the carrying case 105 is designed with a fabric or other durable material making up a back wall segment, a bottom wall segment, and side wall segments. The segments can be formed by separate pieces of material stitched together or from a single continuous piece of material. The edges or ends of the side walls and bottom walls are then affixed to a front wall, which provides the below-described screen access surface 110. The front wall can be made up of a durable, thin, transparent material, such as a transparent film or covering. The combination of the back wall, side walls, bottom wall and front wall provides an interior volume of a dimension that is of sufficient width and height and depth to allow a portable electronic device having a viewable screen to be placed within the volume. As shown by FIG. 3, the portable electronic device 305 is placed within the carrying case with the viewable screen placed in the direction of the front wall. By placing the portable electronic device in this direction within the carrying case 105, the viewable screen is exposed within the front wall for user interfacing therewith. When the viewable screen is a touch-screen, the screen access surface 110 within the front wall overlays the touch screen and a user is able to directly interface with the touch screen through the transparent front wall, without having to remove the device from the carrying case 105.

In an alternate embodiment, the front wall can actually be constructed with an outlying wall around the perimeter that is then open in the center (i.e., no actual physical material), such that direct access is provided to the screen of the electronic device. In yet another embodiment, applicable to both types of front wall construction, a cover flap can be provided that overlays the front wall. The cover flap can be made of any material, but is generally not transparent, so as to prevent the electronic device from being directly viewable while the device is being transported within the carrying case. The user of the electronic device can then simply pull the flap out of the way when the user desires to access the screen of the electronic device.

According to another aspect of the disclosure, the carrying case includes a top wall and a zipper disposed in at least one of the side walls and the top wall. In one embodiment, the zipper can be partially disposed in the bottom wall and the top wall and extend along one of the side walls. In one or more embodiments, the zipper can be placed along a single wall or along multiple walls. When the zipper is in the opened position, the opening provided is sufficiently large to insert the electronic device into the carrying case without difficulty. It is appreciated that other embodiments can provide a different mechanism by which the devices can be inserted into the carrying case and secured therein, including, but not limited to use of a top cover that can be affixed at one end to one or more of the other walls and secured at the other end to the carrying case by Velcro®, or a snap-in connector or other connector. Yet another embodiment can involve use of Velcro® or other adhesive mechanism at the top of the carrying case to temporarily attach the inner surface of the top edge of the front wall to the top edge of the back wall, for example. Thus, the electronic device can be easily inserted and removed from the carrying case through the zipper opener or other mechanisms, such as Velcro or buttons.

As another aspect of the disclosure, the point of connection between the front wall and the rest of the carrying case provides a seam. The connecting wall edges of the carrying walls can be affixed to the front wall by one of several available mechanisms or bonding methodologies that creates a strong durable bond, which does not release and/or cannot be easily broken by normal interior or exterior stretching of the walls as electronic devices are placed within the carrying case volume. The seams are also constructed to be resistive to separation in response to tensile or other forces applied to the seam or the carrying case.

According to one aspect of the disclosure, the carrying assembly includes and/or is designed to be utilized with a strap. In one embodiment, the strap is a basic loop (i.e., a bandolier/sash) that is made of durable material and designed for use as a shoulder strap or an around-the-waist carrying belt. The carrying case is removably connected to the strap via an interlocking mechanism, such that a user can remove the carrying case with the electronic device from its connection to the strap and utilize the electronic device, while still in the carrying case. Once use of the electronic device is completed, the user can then easily reconnect the carrying case to the strap utilizing the interlocking mechanism.

Thus, as one related aspect of the disclosure, the carrying case assembly includes an interlocking mechanism comprised of a female receptacle and a male affordance that insertably connects and/or latches to the female receptacle. A first part (male or female) of the interlocking mechanism is attached to the back wall and/or the top wall of the carrying. In one embodiment, a push buckle and latch device is utilized to provide the male and female parts, which securely interlocks when connected. Importantly, once interlocked, the two parts can only be unlocked by user manipulation of one or more release affordances of the interlocking mechanisms. This aspect prevents the carrying case from being detached from the strap without specific, deliberate, user action. In one embodiment, the latch device (which is technically referred to as a latchplate or latch, for short) is configured similarly to a car seatbelt buckle assembly or an airplane seat buckle assembly. For purposes of the description, reference will be made to the female (receptor) part as a "buckle", and the insertable male part as a "latch". According to one implementation, the buckle is attached or fastened to the top of the carrying case or bag. The location of the buckle can be generally top center to allow for balancing of the carrying when attached to a strap, as described below. Other locations can be desirable depending on the weight and dimensionality of the carrying and/or the device for which the carrying case is designed to house. According to one embodiment, the latch can be either permanently or temporarily attached to the strap. It is appreciated that the location of the male and female parts of the interlocking mechanism of a buckle and latch device can be reversed relative to connection with the carrying case and the strap. While shown to be similar in design to a seat belt buckle as utilized in automobiles and airplanes, it is appreciate that the buckle can be designed very differently and take on different shapes and provide different forms of locking features, as a design option.

According to one embodiment, the detachable carrying case assembly is an iPad®/eReader® messenger bag system. The iPad®/eReader® messenger bag system is an assembly of a carrying case and messenger bag strap that allows an iPad/eReader carrying case (or bag) to quickly detach from the bag strap for ready use and access, and then re-attach for easy hands free carrying, through use of the interlocking mechanism. An iPad/eReader placed in the Clip and Carry™ case is accessible by simply detaching the carrying from the strap, by use of a release mechanism of the push buckle or latch, then engaging the screen or face of the iPad/eReader through the transparent (or open) front wall of the carrying case.

According to one embodiment, the strap can contain additional pockets or places for additional items. Also, when made as a shoulder strap, the strap can be worn from either shoulder, and can be adjustable. According to one aspect, the iPad®/eReader® carrying case will hang around the hip of the user when attached to the strap, in part determined by the adjustment made to the strap. In this location, a user can easily detach the carrying case from the strap by pushing the button on the female buckle (or release latch). The user is then able to operate the iPad/eReader through the touchscreen viewable at the front surface of the carrying case. Once the user is finished with the device, the user can simply reconnect the buckle and latch together, providing an easy Clip-n-Carry™ application.

In one embodiment, the assembly of the casing, interlocking mechanism and strap is designed to allow the front wall of the casing to generally face towards the body or hip of the user wearing the carrying case assembly when the strap is placed over the shoulder or around the waist.

According to one embodiment, the back side of carrying case includes pockets for accessories, or other devices, such as, but not limited to, larger notebook computers. In one embodiment, the pockets can be made of rubber or plastic and provide extra grip material for contoured holding. The extra grip material can also be used on the back side of buckle, in one embodiment.

In one embodiment, the back side also has a folding flap, which allows the carrying case to stand upright. This further enables table viewing of the screen of an inserted electronic device or use of the device with a keyboard or other external input device. As shown, the folding flap can be configured with multiple movable parts that collapse to present a flat assembly when the carrying case is being carried or used as a holder for the device. The folding flap can then be manually re-configured to provide one or more arms that support holding the carrying case in an upright position. In one embodiment, the folding flap is detachable from the carrying case and can be attached as needed. The folding flap can then be held within one of the pockets provided at the back of the carrying case or on the strap.

In one embodiment, the holes include ones for a camera lens and an on/off switch of the portable electronic device. The screen of the portable electronic device is then visible through the screen access surface, which can include a clear film cover. Zipper enables access to compartment. When required for the portable electronic device, carrying case 105 can include an opening at the bottom center of the exterior casing for insertion of a charger. In one embodiment, a secure metal ring or other affordance (e.g., a D-ring) hangs at the bottom of the external casing to attach other accessories to carrying case 105.

Figure 2:
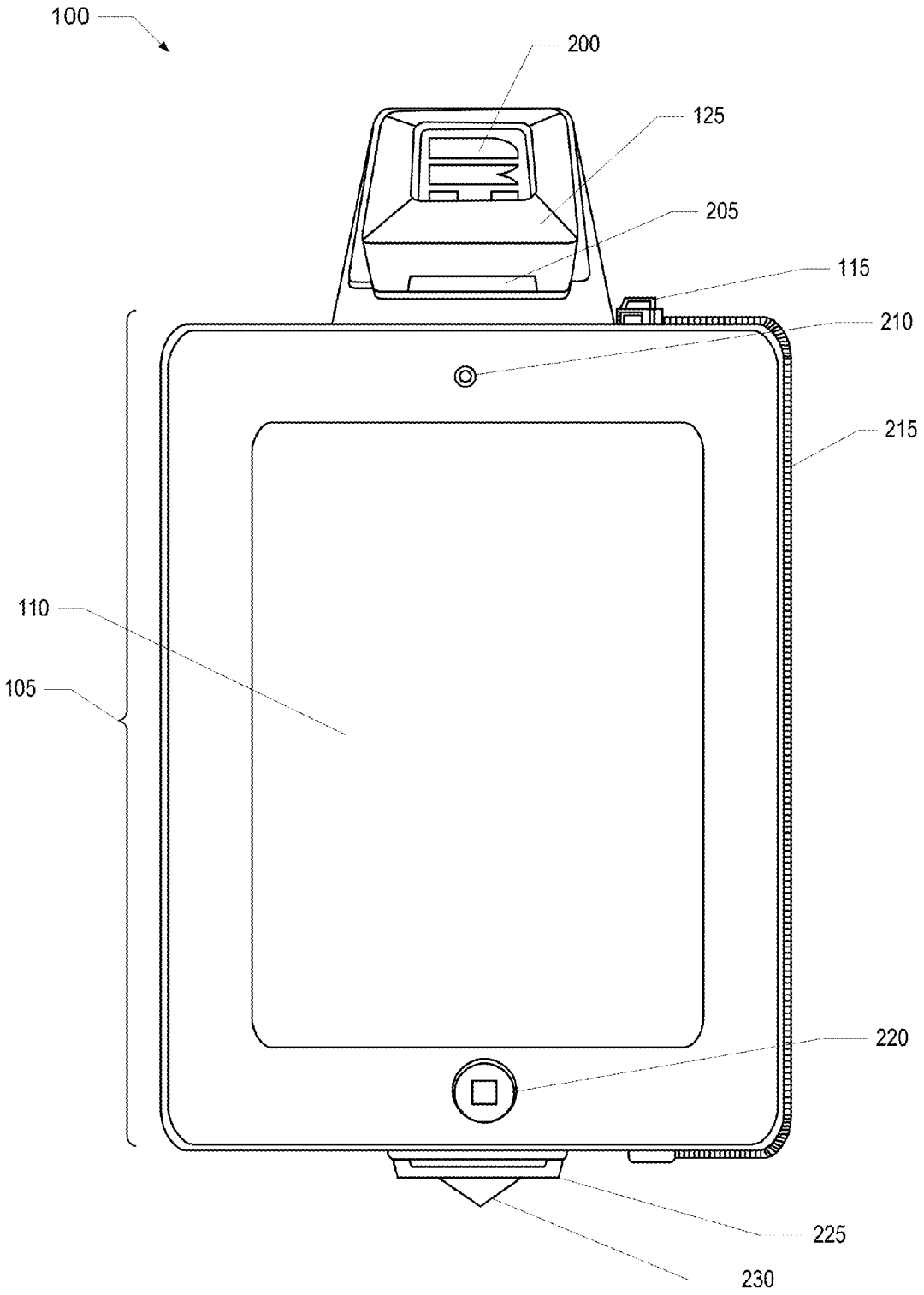
FIG. 2 illustrates a frontal view of the example carrying case of FIG. 1, further displaying a screen access surface, in accordance with one embodiment.

With reference now to the figures and specifically referring to FIGS. 1-3, where like elements are provided with a same reference numeral, there are illustrated three different views of components of a carrying case assembly 100 (minus the strap) for portable electronic devices (generally 305, FIG. 3), such as an iPAD® or tablet or laptop, for example. The carrying case assembly 100 includes a carrying case 105 (indicated using dashed outline) that comprises an exterior casing (generally, the fabric creating the structure of carrying case 105) that creates a compartment 300 (interior to the exterior casing) within which a portable electronic device 305 can be inserted for storage and use therein (see FIG. 4). The carrying case assembly 105 further includes means (e.g., zippers 215, with zipper handles 115) for securing the portable electronic device 305 within the compartment 300 when the electronic device 305 has been inserted in the compartment 300 of the carrying case 105. It is understood that, while the means for securing the portable electronic device 305 in carrying case 105 are illustrated as a zipper 215, other and/or additional means can be utilized in alternate embodiments. Thus for example, the means can include a Velcro® instituted means or the means can include a set of buttons or a set of snap-in components or one or more ties or strings or wires that securely connects one surface 315 of the open compartment 300 with the opposite surface 320 of the compartment 300 to prevent the inserted electronic device 305 from falling out during use and during movement of the carrying case assembly 100. It is also important to note that that alternate embodiments can allow for a permanent insertion of the portable electronic device 305 into the carrying case assembly 105 by using a more permanent means for securing the opposing surfaces of the compartment together once the portable electronic device 305 is inserted in the compartment 300. Thus the use of glue or epoxy or a stitching together of the surfaces can also be provided, in these alternate embodiments. These permanent implementations may be implemented in a factory setting, such as during or after manufacture of the portable electronic devices 305, thus further enhancing the instant portability aspect of the portable electronic device 305.

Refocussing on FIGS. 1-3, the carrying case assembly 100 also includes a first component 125 of an interlocking mechanism (generally 800, FIG. 8) attached to the carrying case 105 and utilized to hang the carrying case 105 on a user wearable strap 150 (see FIGS. 9-11) configured with a second component 160 of the interlocking mechanism 800. In one embodiment (not shown), the first component 125 can be directly connected to the exterior surface of the carrying case 105. However, according to the illustrative embodiment, the carrying case 105 includes an extension of a supporting structure 130 to which the first component 125 is fixably attached. It is appreciated that while carrying case 105 is delineated by the dashed line enclosure as being the bag or device-holding component of the carrying case assembly 100, the construction of carrying case 105 includes the extension of supporting structure 130, which can run vertically through carrying case 105 or along the frame of the exterior casing, or in some other configuration. Supporting structure 130 extends upwards beyond the top of the carrying case 105 to provide a connecting base for affixing the first component 125 of the interlocking mechanism 800. In one embodiment, this supporting structure 130 can itself be configured to provide the functionality of a first component (125) for interlocking with the second component 160 of the interlocking mechanism 800 (see, for example, FIG. 10). In addition to the supporting structure 130, carrying case 105 can be configured to include additional cushioning material (not specifically shown) to cushion an impact of the carrying case 105 hitting against the body of the user 1105 (see FIGS. 11-13) wearing the carrying case assembly 100. The carrying case 105 can be a rigid bag, a pliable bag, a sleeve, or simply a fabric enclosure that enables insertion of the portable electronic device 305. The carrying case 105 can also be created using moldable and injectable plastic, leather, other textile, fabric, or other constructable material. Regardless of the material and/or structure or design of the carrying case 105, the carrying case 105 and in particular the detachable carrying case 140 includes at least one affordance that enables the carrying case 105 to be attachable to and detachable from a user wearable strap 150 via an interlocking mechanism 800. The attachment and/or inclusion of this affordance, such as, but not limited to the first component 125, to carrying case 105 enables carrying case 105 to become or be referred to as a detachable carrying case 140. In one implementation, the affordance can comprise a strap or fabric stitched into or extended from the fabric making the carrying case 105, without having an extension per se as shown in the figures. These and other alternate embodiments are contemplated by the disclosure as being equivalent structures.

Referring specifically to FIG. 2, which shows a front view of the carrying case 105. As presented, first component 125 of the interlocking mechanism 800 (FIG. 8) is a buckle having a slot 205 for receiving an insertion of a latch (not shown). Buckle (as first component 125) also includes a release button 200 that can operate as a lock for the interlocking mechanism 800, in one embodiment. Indicated within the front surface of the carrying case 105 is an eyehole or slot 210 for a camera lens of the inserted portable electronic device 305. Zipper handle 115 is shown attached to zipper 215, which runs down along the side of carrying case 105 to the bottom surface of carrying case 105. Within the bottom section of the front surface is another hole or slot 220 that enables user access to an on/off button of the inserted portable electronic device 305. Located within the bottom surface of the carrying case is yet another slot 225 that provides access to the charging port of the inserted portable electronic device 305. Additionally, extending off the bottom of the carrying case and securely attached thereto is an accessories bar 230 made of metal or other material and to which one or more accessories can be attached.

Additionally, the carrying case 105 includes: a screen access surface 110 within the exterior casing which provides viewable access to a screen (see 310, FIG. 3) of the inserted portable electronic device 305. As a simplest implementation, the screen access surface is an opening within the exterior case having a perimeter edge shaped to extend around a perimeter of the screen 310 of the inserted portable electronic device 305. However, within the illustrative embodiment, the screen access surface 110 is a physical layer that includes a material that overlays and protects a surface of a screen 310 of the inserted portable electronic device 305. Additionally, the screen access surface 110 can be constructed with a material that enables the screen access surface 110 to transfer tactile inputs received on an exterior surface of the material to the screen 310 of the portable electronic device 305. This transfer of tactile input allows for external control of the portable electronic device 305 when the portable electronic device 305 has a touch screen interface (via screen 310). In at least one embodiment where the screen of the portable electronic device 305 is viewable, the screen access surface 110 is constructed of a material that is transparent. As presented in the figures, the first component 125 of the interlocking mechanism 800 is located at a top of the carrying case 105 in an orientation that enables the screen 310 of the inserted electronic portable device 305 to be oriented towards a body of a user wearing the carrying case assembly 100 (see FIGS. 10-12) when the first component 125 is interlocked with the second component 160.

The above introduced cushion segments (i.e., cushioning material) can be located within perimeter sections of the screen access surface 110 to protect the screen 310 from damage due to physical impact of the carrying case 105, such as if the carrying case 105 is dropped on the face in which the screen access surface 110 is embedded. The cushioning material cushions an impact of the carrying case 105 hitting against the body of the user wearing the carrying case assembly 100 and protects the inserted portable electronic device 305 from damage when the carrying case 105 is brought into forceful contact with other objects.

Figure 4:
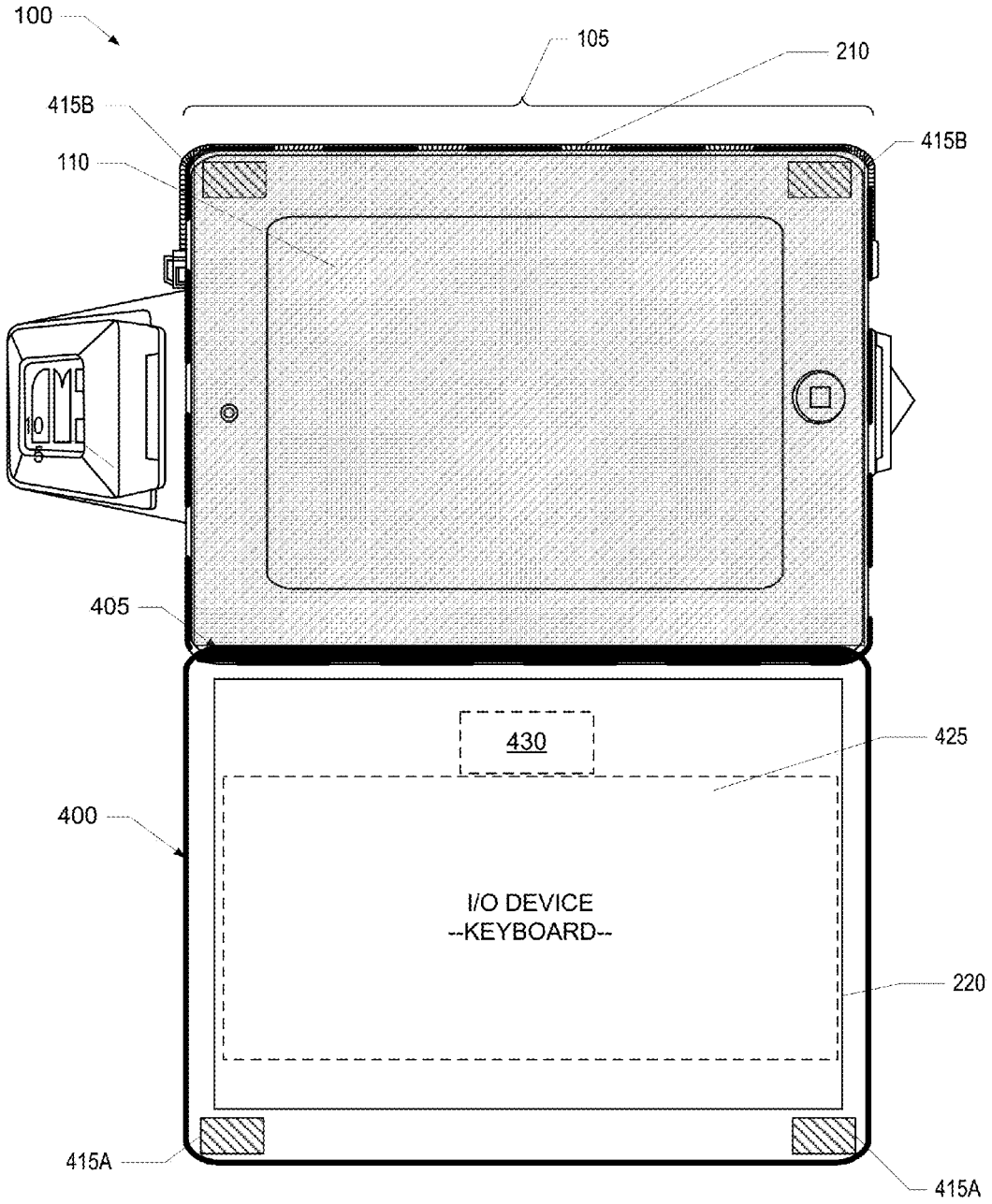
FIG. 4 illustrates features of an example flap that covers the screen access surface of the carrying case, in accordance with one or more embodiments.

In one or more embodiments and as illustrated by FIG. 4, the carrying case 105 and/or more generally, the carrying case assembly 100 includes: a cover flap 400 that attaches to a perimeter section 405 of the screen access surface 110 and is movable into one of (i) a closed position (illustrated in phantom with dashed lines and shade) that covers and prevents access to the screen 310 of the inserted portable electronic device 305 and (ii) an open position (shown) that exposes the screen access surface 110. Depending on the specific embodiment implemented, the cover flap 400 can be one of: (a) (permanently) affixed at one end to a perimeter section 405 of the carrying case; or (b) a separate component (not shown) from the carrying case. When a separate component, the cover flap 400 is removably attached to the perimeter section 405 of the screen access surface 110 via one or more adhesive means 415. When one end of cover flap 400 is permanently attached to the perimeter section 405, the other ends can also include adhesive means 415, which enable the cover flap to be secured in place when in the closed position. As shown, adhesive means 415 includes first attachments 415A located on cover flap and second attachments 415B located on screen access surface 110. According to one or more embodiments, the above introduced means for securing the portable electronic device 305 within the compartment 300 and the adhesive means 415 utilized for the cover flap 400 can include one or more of a zipper, a Velcro® connection, a button with opposing hole in a fabric of the exterior casing, a clasp, a latch, a string, and a snap-in button mechanism, dual interlocking magnets, among others. Accordingly, the cover flap 400 includes one or more of the adhesive means 415 at one or more perimeter sections 405 of the cover flap 400, and this use of an adhesive 415 to secure at least one end of the cover flap 400 enables the cover flap 400 to be securely attached to an opposing perimeter section of the screen access surface 110.

In at least one embodiment, illustrated by FIG. 4, a user interface device 425 (shown in phantom using a dashed outline) is embedded in an inner surface of the cover flap 400. The user interface device 425 is accessible when the cover flap 400 is in the open position (FIG. 4). To support use of the user interface device 450 with the inserted portable electronic device 305, a communication mechanism (shown generally as phantom box 430) is also provided that enables the user interface device 450 to communicatively couple to the inserted portable electronic device 305. The communication mechanism 460 includes one or more of: (i) a wired connection extending from the cover flap 400 to an interior of the compartment 300 and having a connective end for insertion into the inserted portable electronic device 305; and (ii) a wireless connection that connects with the inserted portable electronic device 305 via a created close-range wireless channel (e.g., Bluetooth or NFC or infrared) following a pairing of the inserted portable electronic device 305 with the user interface device 450. In at least one embodiment, the user interface device 425 is a WiFi keyboard.

Figure 5:
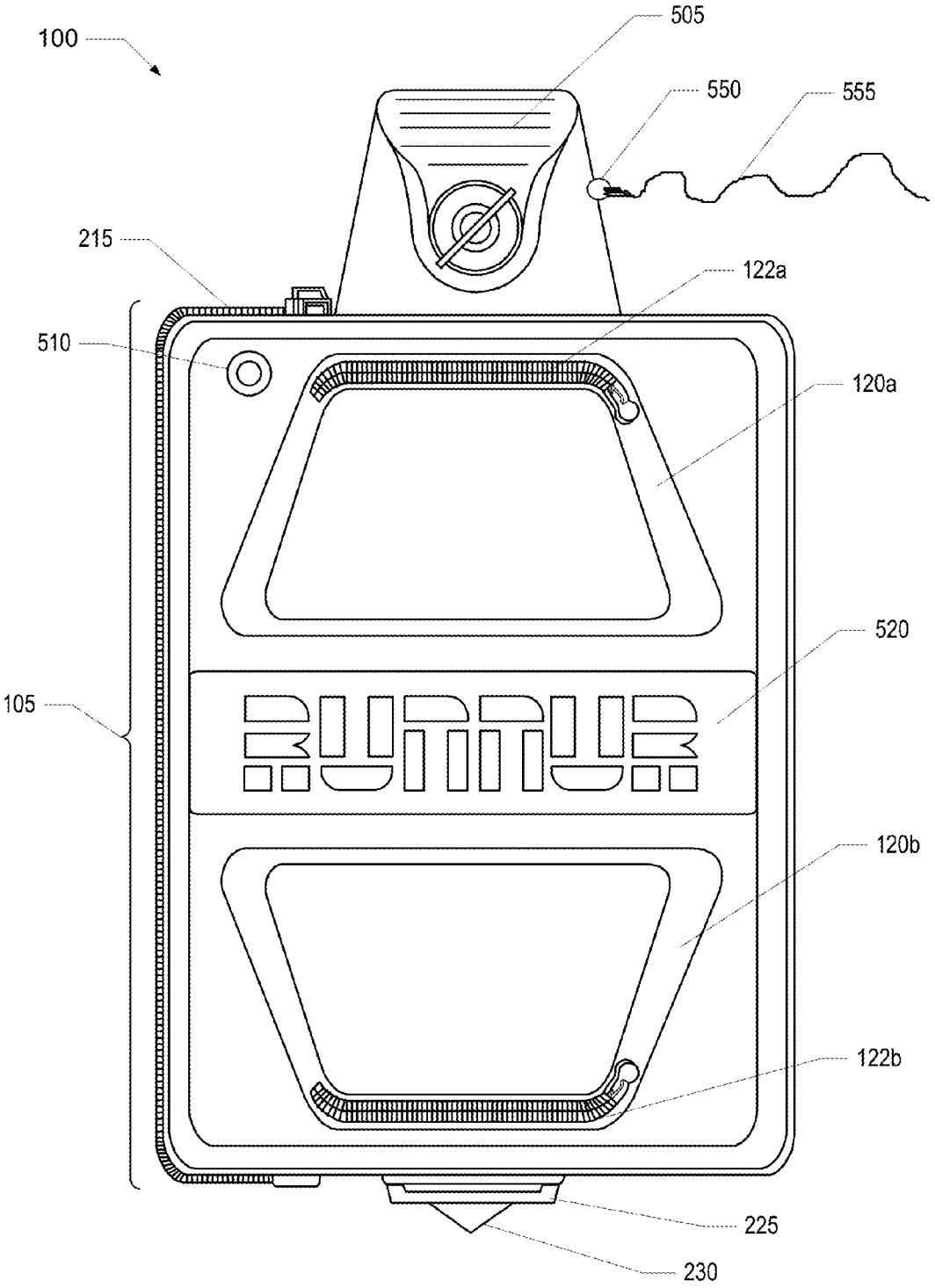
FIG. 5 presents a rear view of the example carrying case of FIG. 1, further displaying a set of pockets and other functional aspects of the carrying case, in accordance with one embodiment.

Referring now to FIG. 5, which illustrates a rear view of carrying case 105, showing the rear exterior panel, according to one embodiment. Rear exterior panel provides a handle 505 composed of rubber or other grippable material that allows the user to securely hold the detachable carrying case 140 using the handle 505 during detaching and/or attaching of the first component 125 to the second component 160 of the interlocking mechanism 800. Also shown is a camera eyehole 510 and pockets 120*a*, 120*b* for holding accessories. The pockets are shown having respective zippers 122*a* and 122*b*. Additionally, rear exterior panel of carrying case 105 includes a folding flap 520 having at least one segment that is extendable away from the carrying case 105 to provide a pivot that enables the carrying case 105 to be placed in an upright position or orientation. As provided by FIGS. 5 and 6, the folding flap 520 is configured with multiple movable parts or segments that are collapsible to present a flat assembly adjacent to a surface of the carrying case 105 (see FIG. 5) when the carrying case 105 is not being supported in a vertically upright position. In at least one embodiment, the folding flap 520 is completely detachable from the carrying case 105 and attachable using one or more adhesive means, as defined herein.

As a general implementation detail when looking at carrying case 105 in FIG. 5, the compartment 300 of the carrying case 105 has a size dimension that enables insertion and support of specific types, shapes, and sizes of portable electronic devices 305. As one aspect, the dimension of the compartment 300 of the carrying case 105 is adjustable to fit multiple different sizes of portable electronic devices 305. Also, the carrying case 105 can be designed for specific devices or generally to accommodate multiple different devices. For example, the carrying case 105 can be configured as a case for one of a single panel device, such as a tablet, with an aft-facing screen. As another example, the carrying case 105 can be configured to hold a multi-panel electronic device, such as a laptop computer, in one of a full insertion into the compartment or a partial insertion into the compartment. When the carrying case 105 is designed to allow partial insertion of a laptop computer, the laptop keyboard and laptop screen can be placed inside of opposing surfaces of the cover flap 300 and the screen access surface 110 of the carrying case 105. In this embodiment, the carrying case 105 includes the cover flap 400 that attaches to a perimeter section 405 of the screen access surface 110 and is movable into one of (i) a closed position that covers and prevents access to the laptop and (ii) an open position that exposes the laptop keyboard and laptop screen in opposing surfaces of the cover flap 400 and the carrying case 105. As one possible extension to this embodiment, the carrying case 105 can also include a security strap (not shown) that extends across the exterior portion of the cover flap 400 and the exterior portion of the carrying case 105 to hold the cover flap 400 and the carrying case 105 in a closed position.

Figure 6:
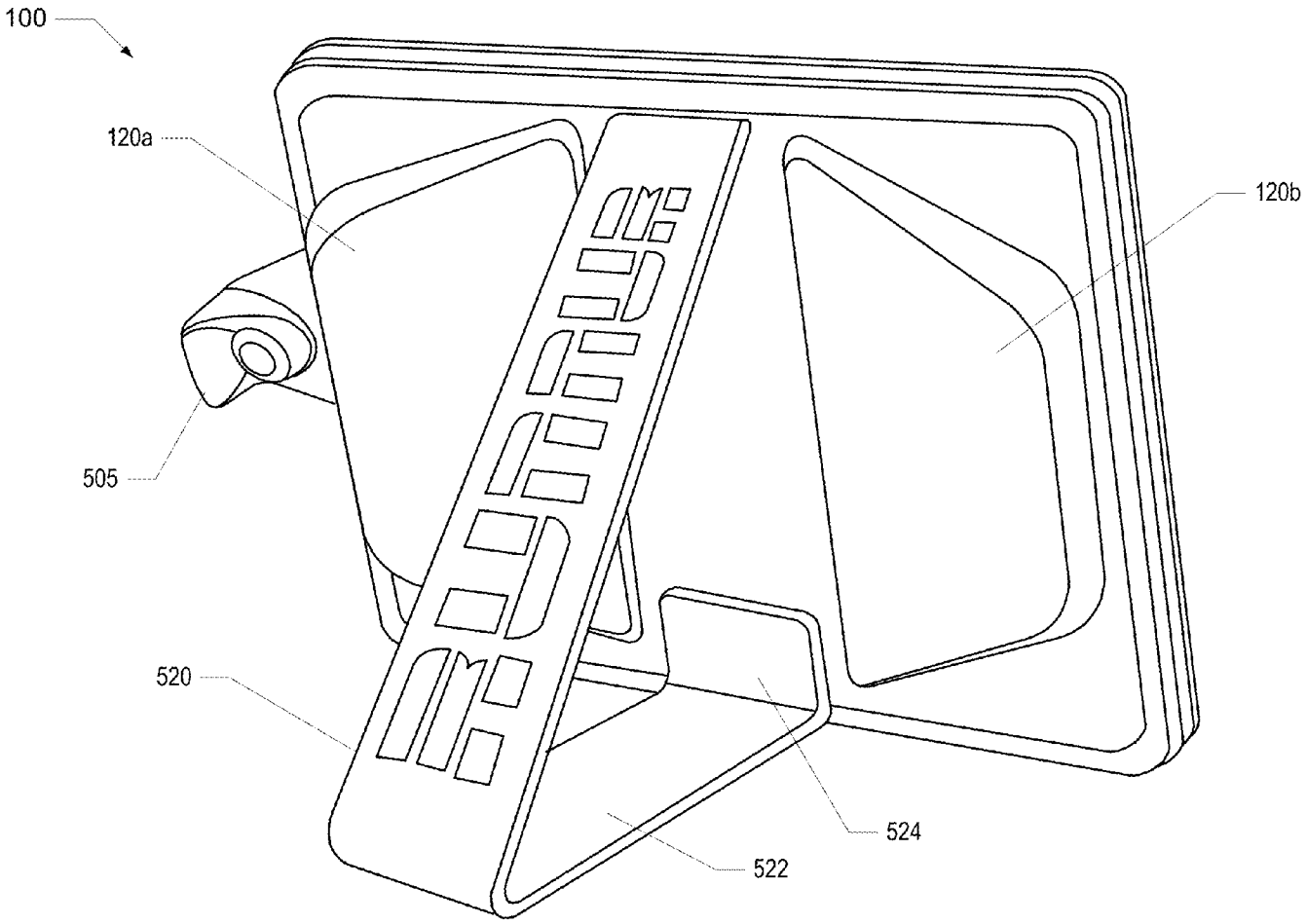
FIG. 6 is a rear isometric view of the example carrying case with a foldable flap extended to an open position to provide a standing base (or pivot) for the case, according to one embodiment.

As is further illustrated by FIGS. 1, 5 and 6, the carrying case 105 can include at least one pocket 120 positioned in an outside surface that is oriented away from an inside position of the first component of the interlocking mechanism 800. It is appreciated that while two pockets are shown of apparent equal size and/or shape, that the carrying case 105 can be designed with no pockets, multiple pockets of different shapes and sizes, pocket that close with zippers, snap-ins, Velcro, or other closing affordances, and the like. Also, as further illustrated, the carrying case 105 can include one or more openings 150 within the external casing to support access to corresponding one or more of input/output jacks, power ports, communication ports, user interface affordances, and a camera of the inserted portable electronic device 305. Access to perform the various functions with the portable electronic device 305 can then be provided via the one or more openings 150, while the inserted personal electronic device 305 is located within the carrying case 105. Also, with further reference to FIG. 5, in at least one of the illustrated embodiments, the carrying case 105 further includes an attachment affordance 550 (e.g., a hole or connector) that enables fixable connection of a wire that extends from the carrying case 105 to a retraction device (see 1120, FIG. 11) on the user wearable strap (see 1100, FIG. 11). The inclusion of the wire 555 and attachment affordance 550 restricts a distance from the user wearable strap 1100 from which the carrying case 105 can be moved. It is appreciated that the location of the attachment affordance 550 can be different from that shown, and the figures is solely intended to be used as an example of one possible location. Other embodiments can provide the attachment affordance at different locations of the detachable carrying case 140, based on one or more design choices. Yet additional embodiment utilizes existing attachment structures of carrying case 105, such as accessory bar 230.

Figure 7B:
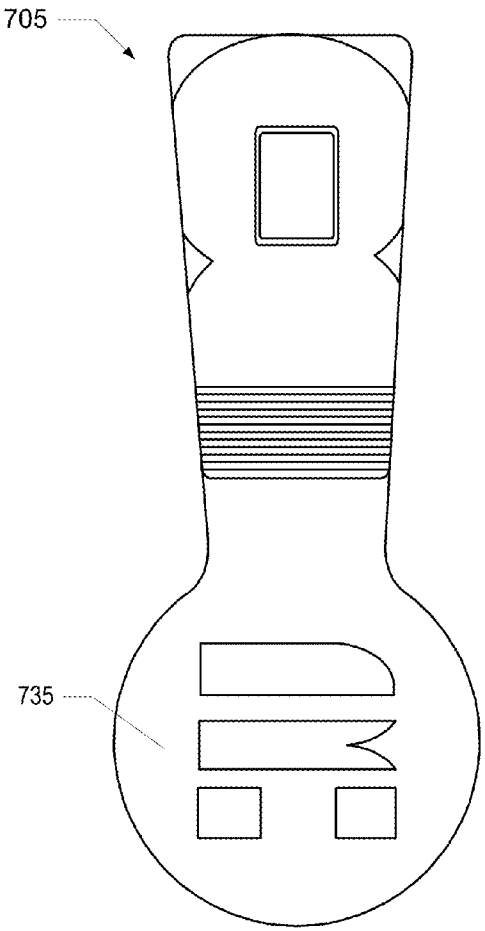
FIG. 7B illustrates a front view of a base member of the holding clip of FIG. 7A, with circular base, according to one embodiment.
Figure 7A:
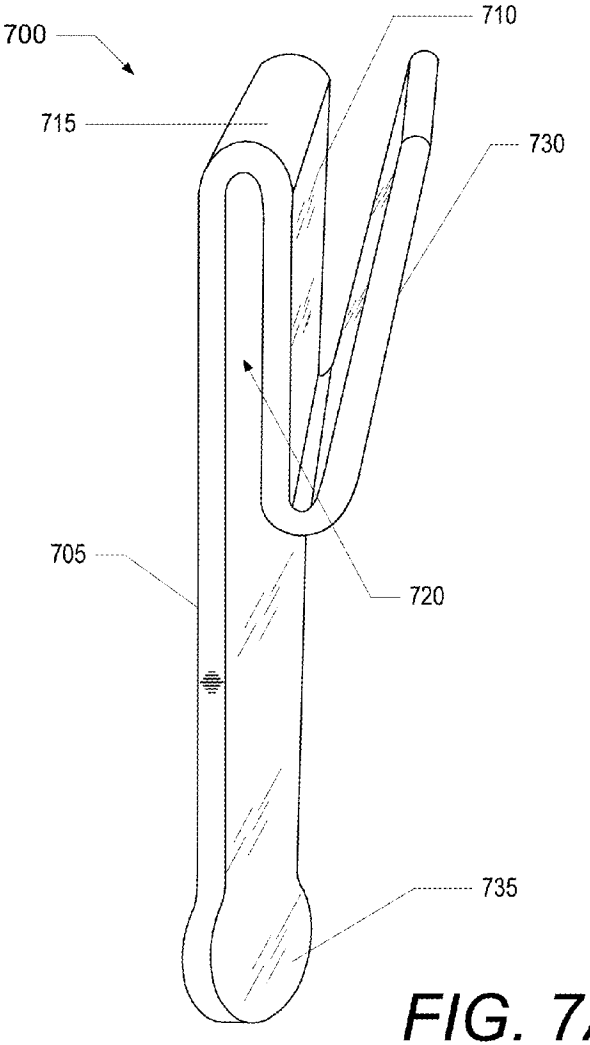
FIG. 7A provides a lateral view of an example holding clip that serves as a second component of the interlocking device for hanging the carrying case on a user wearable strap, in accordance with one embodiment.

Referring now to FIGS. 7A and 7B, in one embodiment, the carrying case assembly 100 includes a holding clip 700 designed for attachment to a user wearable strap 150. The holding clip 700 is configured with: (i) a first connecting section 705 that securely attaches the holding latch to the user wearable strap 150; and (ii) a second connecting section 715 serving as the second component of the interlocking mechanism 800. The second connecting section 715 receives the first component 125 attached to the carrying case 105 and enables the carrying case 105 to be fixably and removably attached to the holding clip 700 and indirectly to the user wearable strap 150. The holding clip 700 is made of a material (e.g., a durable metal) having compressive and tensile strength that supports moveable hanging of the carrying case 105 off the clip 700 with the portable electronic device 305 and other objects inserted in the carrying case 105.

When, as shown by FIG. 7, the holding clip 700 is a separate, detachable item from the user wearable strap 150, holding clip 700 includes: a first segment, or first connecting section 705, that extends vertically downwards to slip into an inner section of the user wearable strap 1100; a middle segment 710, connected to the first segment 705 and extending downwards away from the connecting end 715 with the first segment 705 to provide an elongated receiving section 720 between the first segment 705 and the middle segment 710 having a width and length dimension that enables a secure connection to the user wearable strap 150. The holding clip 700 further includes a device connecting segment 730 that connects to and extends from the middle segment 710 at an angle that supports efficient interlocking of the first component 125 with the device connecting segment 730. The device connecting segment 730 is configured with specific dimensions to be the second component (160) of the interlocking mechanism 800. According to one aspect of the illustrative embodiment, as provided by FIG. 7B, the first segment 705 of the holding clip 700 terminates in a circular end 735, opposed from the connecting end 715 with the middle segment 710 to support lateral movement of the carrying case 105 when attached to the holding clip 700. While the figures provide a specific shape of holding clip 700, the description is not mean to be limiting on the disclosure. Other forms or designs of holding clips are possible and are covered within the alternate embodiments of the disclosure. For example a single segment holding clip can be implemented that is insertable into both the strap 150 and the buckle 810 at opposing ends. The descriptions presented herein are therefore to be given their broadest possible reading to include the entire spectrum of equivalent structures.

Figure 8:
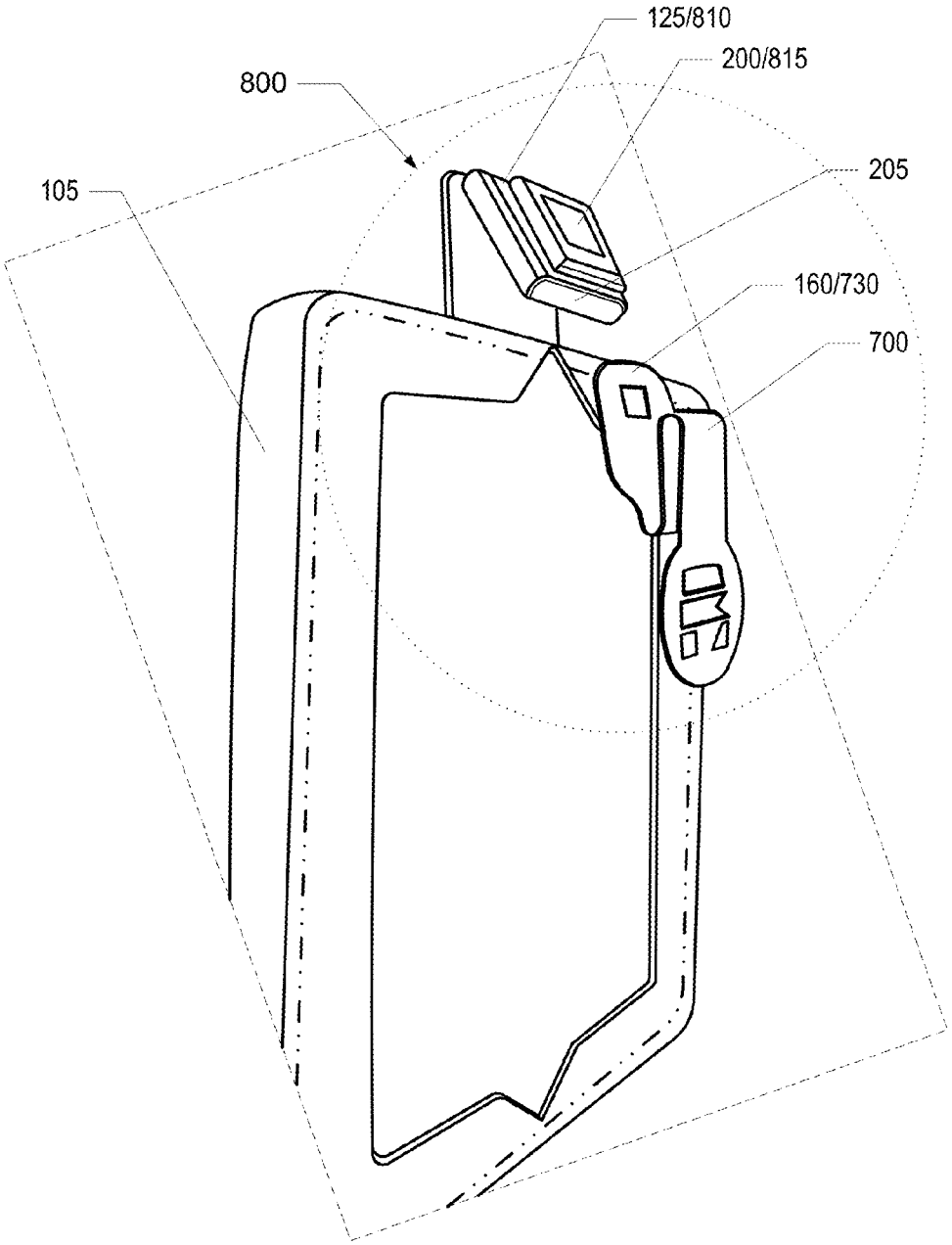
FIG. 8 illustrates an example interlocking mechanism made of a buckle and latch assembly, in accordance with one or more embodiments.

Referring to FIG. 8, there is illustrated one example of the interlocking mechanism 800 which includes a first component that is inserted into a second component or vide-versa. In this illustration, the interlocking mechanism 800 includes a buckle 810 representing first component 125 and holding clip 700 having device connecting segment 730 representing a second component 160. It is appreciated that the specific component that is the first component versus the second component can vary, with one of the first component and the second component being the buckle and a next one of the first component and the second component being the clip. In one or more embodiments, the angle (orientation relative to vertical) of the buckle is adjustable to accommodate different orientations of the carrying case 105 when attached to the wearable strap 150.

Also, in one embodiment, the interlocking mechanism 800 includes a locking component 815 that enables the interlocking mechanism 800 to be locked following insertion of the clip 700 into the buckle 810. Setting of the locking component 815 prevents the clip 700 from being detached from the buckle 810 without actual user manipulation of the buckle 810 and locking component 815. In one embodiment, the locking component 815 automatically locks in place whenever clip 700 is inserted into the buckle 810, without any user manipulation.

In an alternate embodiment, the interlocking mechanism 800 can be a pair of magnets, with a first magnet being the first component and a second magnet being the second component. The selected magnets have sufficient magnetic strength to hold the carrying case 105 in place and enable movement of the carrying case 105 when the magnets are interlocked with each other. The magnets can be respectively stitched into the fabric of carrying case 105 and wearable strap 1100.

Figure 10:
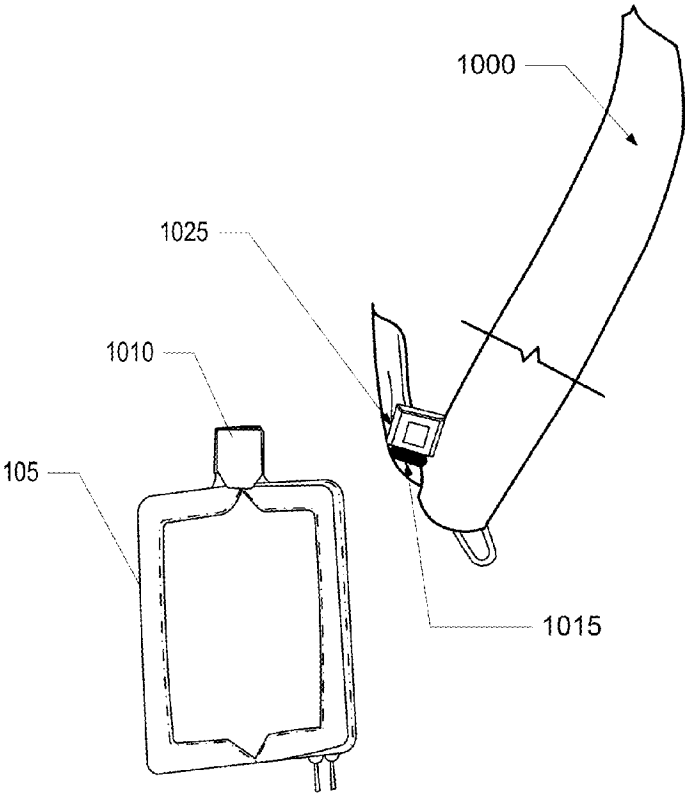
FIG. 10 illustrates an example carrying case assembly with the interlocking mechanism being a buckle and latch system with the buckle attached to the wearable strap as the second component and the latch serving as the first component of the interlocking mechanism, in accordance with an alternate embodiment.
Figure 9:
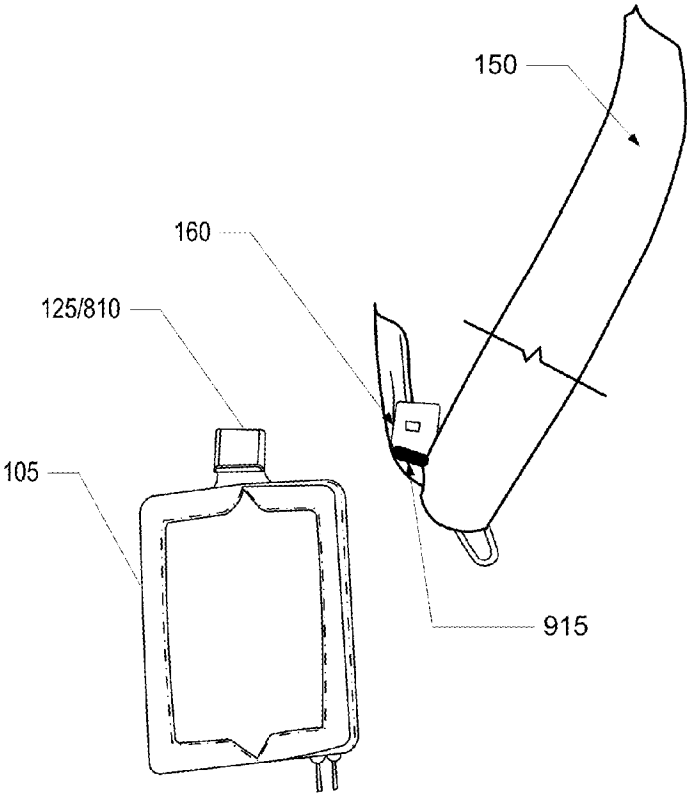
FIG. 9 illustrates an example carrying case assembly with a latch attached to a wearable strap serving as the second component of the interlocking mechanism, according to one embodiment.
Figure 11:
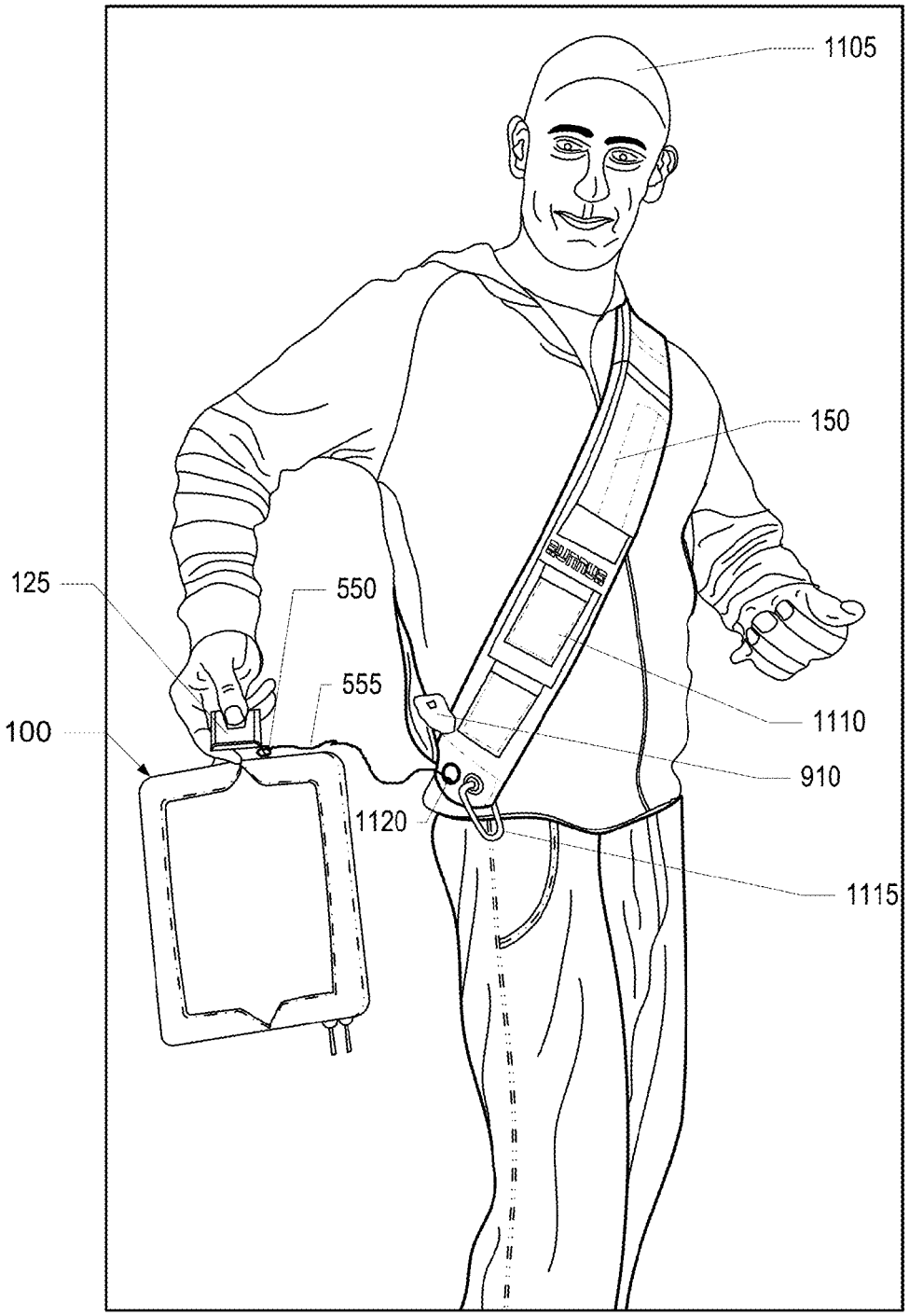
FIGS. 11 and 12 illustrates a user interlocking of the carrying case to a wearable strap using a buckle and latch system as the interlocking mechanism, where the latch is fixably attached to the wearable strap, in accordance with one embodiment.

It is appreciated, that the actual one of the components, first or second, that is provided as the buckle 810 as well as the specific configuration of the latch provided to interlock therewith can vary depending on implementation, as is shown with the alternate embodiments of FIG. 9 and FIG. 10. In one alternate embodiment, illustrated by FIG. 9, user wearable strap 150 is designed with an embedded holding clip 160 permanently affixed at a first connection section 915 to the user wearable strap 150. Conversely, with FIG. 10, a buckle 1025 is attached to the user wearable belt 1000 via a connector 1015 and receives a downward-angled latch 1010 that is affixed to carrying case 105. As shown for both the FIG. 8 and FIG. 9 illustrations, the holding clip 700 and embedded holding clip 160 are respectively positioned at an angle relative to the user wearable strap 150 to enable efficient interlocking of the first component 125 attached to the carrying case 105 with the second component (i.e., protruding extension of holding clip 700/160). Thus, the interlocking mechanism comprises a buckle and latch assembly. In one embodiment, the angle of the interlocking mechanism can be adjusted by positioning of the wearable strap to accommodate different orientations of the carrying case when attached to the wearable strap.

Referring now to FIGS. 11-14, there are depicted examples of one other component of the carrying case assembly 100, specifically user wearable strap 150. The user wearable strap 150 can be configured as one of (a) an over-the-shoulder strap that can be worn like a sash to extends over at least one shoulder of a user wearing the carrying case assembly (see FIG. 11-13), (b) a belt that can be worn around one or more body parts, including a hip or waist (see FIG. 14), for example, and (c) an around-the-neck strap. The user wearable strap 150 comprises a loop of durable material that supports a weight of the carrying case 105 with the portable electronic device 305 inserted therein. The carrying case 105 is attached to the user wearable strap 150 by the interlocking mechanism 800 (FIG. 8). In the illustrative embodiments of FIGS. 11-13, the user wearable strap 150 includes a loop that extends over at least one shoulder of a user 1105 wearing the carrying case assembly 100. The loop is sized to accommodate the user's height and girth. According to one embodiment, the wearable strap 150 also includes a refraction component 1120 having a retraction mechanism (not shown) and a wire 555 connected at one end to the retraction mechanism 1125 and having a next end that is attachable to the carrying case 105 to enable restricted movement of the carrying case 105 to a distance of a length of the string away from the wearable strap 150. In one embodiment, the retraction component 1120 can be a slinky wire. As further illustrated, the user wearable strap 150 can include a plurality of pockets of different shape and dimensions for securely holding one or more personal items of the user 1105 while the user wearable strap 150 is being worn. Additionally, the user wearable strap 150 can be adjustable and be fitted to different lengths.

According to the illustrative embodiments, and as shown by FIGS. 8-10, the carrying case 105 includes a first component part of an interlocking mechanism 800 affixed thereto. The user wearable strap 150 also includes a second component part of the interlocking mechanism 800, fixably embedded in one section of the loop. The second component then receives the first component part of the interlocking mechanism 800 when the carrying case 105 is attached to the section of the loop.

The above description of the various figures provides a carrying case assembly 100 that can be designed as an ultra-portable bag or case for an iPad®/eReader® or other tablet device or laptop computer device. The carrying case assembly 100 can also be utilized to port a large number of different portable electronic devices, without limitation. It is appreciated that the carrying case 105 is a detachable item and can be described as such relative to the carrying case assembly 100.

While the disclosure has been described with reference to exemplary embodiments, it will be understood by those skilled in the art that various changes may be made and equivalents may be substituted for elements thereof without departing from the scope of the disclosure. In addition, many modifications may be made to adapt a particular system, device or component thereof to the teachings of the disclosure without departing from the essential scope thereof. Therefore, it is intended that the disclosure not be limited to the particular embodiments disclosed for carrying out this disclosure, but that the disclosure will include all embodiments falling within the scope of the appended claims. Moreover, the use of the terms first, second, etc. do not denote any order or importance, but rather the terms first, second, etc. are used to distinguish one element from another.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The description of the present disclosure has been presented for purposes of illustration and description, but is not intended to be exhaustive or limited to the disclosure in the form disclosed. Many modifications and variations will be apparent to those of ordinary skill in the art without departing from the scope of the disclosure. The described embodiments were chosen and described in order to best explain the principles of the disclosure and the practical application, and to enable others of ordinary skill in the art to understand the disclosure for various embodiments with various modifications as are suited to the particular use contemplated.

What is claimed is:

1. A carrying case assembly for portable electronic devices, the carrying case assembly designed to be worn around a person's torso and comprising:

a carrying case comprising:

an exterior casing that creates an interior compartment within which a portable electronic device can be inserted for storage and use therein; and a fastener for securing the portable electronic device within the compartment when the electronic device has been inserted in the compartment; and a user wearable strap for wearing around a torso of a user;

an interlocking mechanism having:

a first component attached to a top surface of the exterior casing, the first component being a buckle providing a female receptacle with a push button release and which extends in a vertically downward facing orientation; and a second component that is attached to the user wearable strap, wherein the second component is a multi-segmented component which has a first segment that, when the user wearable strap is being worn around the torso of the user, extends vertically upwards as a male latching portion of the interlocking mechanism to latch into the female receptacle of the buckle, the first segment being connected to a second segment that extends vertically upwards away from a first connecting end with the first segment and is connected at an opposing end to a third segment that extends vertically downward from the opposing end of the second segment, wherein the second and third segments attach the second component to the user wearable strap and holds the first segment rigidly vertically upwards such that the first segment extends in a vertically upward orientation away from the strap being worn around the torso of the user to enable vertical interlocking with the vertically downward facing buckle;

wherein the interlocking mechanism comprises a buckle and latch assembly configured to enable vertical attaching, detaching, and hanging of the carrying case on the user wearable strap, where the buckle and latch mate together into a locked position when the buckle is pressed down into contact with the first segment of the second component extending vertically upward, such that the carrying case suspends downwards away from the strap and interlocking mechanism.

2. The carrying case assembly of claim 1, wherein:

an end portion of the third segment is configured in a flat circular bulb shape for user comfort and support;

wherein the first, second, and third segments of the second component collectively provide a vertically oriented flattened S shape with one elongated vertically upright end angled away from the second segment.

3. The carrying case assembly of claim 1, wherein the carrying case further comprises a screen access surface within the exterior casing which provides viewable access to a screen of the inserted portable electronic device, wherein the screen access surface comprises a material that enables the screen access surface to transfer tactile inputs on an exterior surface of the material and transfer the tactile input to the screen of the portable electronic device and control the electronic device when the portable electronic device has a touch screen interface.

4. The carrying case assembly of claim 3, wherein the screen access surface comprises a material that overlays and protects a surface of a screen of the inserted portable electronic device.

5. The carrying case assembly of claim 3, wherein the screen access surface is an opening within the exterior case having a perimeter edge shaped to extend around a perimeter of the screen of the inserted portable electronic device.

6. The carrying case assembly of claim 2, wherein the first component of the interlocking mechanism is located at a top of the carrying case with an orientation that enables the screen of the inserted electronic portable device to be oriented towards a body of a user wearing the carrying case assembly around the torso when the first component is interlocked with the second component.

7. The carrying case assembly of claim 6, wherein the carrying case includes additional cushioning material within perimeter sections of the screen access surface to cushion an impact of the carrying case hitting against the body of the user wearing the carrying case assembly and to protect the inserted portable electronic device from damage when the carrying case is brought into forceful contact with other objects.

8. The carrying case assembly of claim 2, wherein the carrying case further comprises:

a cover flap that attaches to a perimeter of the screen access surface and is movable into one of (i) a closed position that covers and prevents access to the screen of the inserted portable electronic device and (ii) an open position that exposes the screen access surface.

9. The carrying case assembly of claim 8, wherein the cover flap is one of: (a) affixed at one end to a perimeter surface of the carrying case by a permanent adhesive means; (b) stitched at the one end to the perimeter surface of the carrying case; and (c) a separate component from the carrying case that is removably attached to the perimeter of the screen access surface via one or more non-permanent adhesive means.

10. The carrying case assembly of claim 8, wherein the cover flap includes one or more of the adhesive means at one or more perimeter surfaces of the cover flap and which enables the cover flap to be securely attached to an opposing perimeter surface of the screen access surface.

11. The carrying case assembly of claim 8, further comprising:

a user interface device embedded in an inner surface of the cover flap and which is accessible when the cover flap is in the open position; and a communication mechanism that enables the user interface device to communicatively couple to the inserted portable electronic device, wherein the communication mechanism includes one or more of: (i) a wired connection extending from the cover flap to an interior of the compartment and having a connective end for insertion into the inserted portable electronic device; and (ii) a wireless connection that connects with the inserted portable electronic device via a created wireless channel following a pairing of the inserted portable electronic device with the user interface device.

12. The carrying case assembly of claim 11, wherein the user interface device comprises a WiFi keyboard.

13. The carrying case assembly of claim 1, wherein the carrying case comprises at least one pocket located in an opposing surface from a screen access surface of the carrying case.

14. The carrying case assembly of claim 1, further comprising:

a holding clip designed for attachment to a user wearable strap and having: (i) a first connecting section that securely attaches the holding clip to the user wearable strap while the user wearable strap is being worn around the waist or torso of the user; and (ii) a second connecting section serving as the second component of the interlocking mechanism, which receives the first component attached to the surface of the carrying case and enables the carrying case to be fixably and removably attached to the holding clip; and wherein the holding clip is made of a material having compressive and tensile strength that supports moveable hanging of the carrying case off the clip with the portable electronic device and other objects inserted in the carrying case.

15. The carrying case assembly of claim 14, wherein the holding clip is a separate, detachable item from the user wearable strap and comprises:

a first segment that extends vertically downwards to slip into an inner section of the user wearable strap while the user wearable strap is being worn around the waist or torso of the user;

a middle segment, connected to the first segment and extending downwards away from the connecting end with the first segment to provide an elongated section between the first segment and the middle segment having a width and length dimension that enables a secure connection to the user wearable strap; and a device connecting segment that connects to and extends from the middle segment at an angle that supports efficient interlocking of the first component on the device connecting segment and which is configured with specific dimensions to be the second component of the interlocking mechanism.

16. The carrying case assembly of claim 15, wherein the first segment of the holding clip terminates in a circular end opposed from the connecting end with the middle segment to support lateral movement of the carrying case when attached to the holding clip.

17. The carrying case assembly of claim 1, wherein an angle of the buckle is adjustable to accommodate different orientations of the carrying case when attached to the wearable strap.

18. The carrying case assembly of claim 1, wherein the interlocking mechanism includes a locking component that enables the interlocking mechanism to be locked following insertion of the latch into the buckle and prevents the latch from being detached from the buckle without actual user manipulation of the buckle.

19. The carrying case assembly of claim 1, wherein the carrying case is one of a pliable bag, a sleeve, an item created by molded injection, and a fabric enclosure that enables insertion of the portable electronic device and is attachable to and detachable from a user wearable strap via the interlocking mechanism.

20. The carrying case assembly of claim 1, wherein the carrying case is configured as a case for one of a single panel device, such as a tablet, and a multi-panel electronic device, such as a laptop computer.

21. The carrying case assembly of claim 2, wherein the carrying case is a laptop carrying case and the carrying case further comprises: a cover flap that attaches to a perimeter of the screen access surface and is movable into one of (i) a closed position that covers and prevents access to the laptop and (ii) an open position that exposes the laptop keyboard and laptop screen in opposing surfaces of the cover flap and the carrying case; and a security strap that extends across the exterior portion of the cover flap and the exterior portion of the carrying case to hold the cover flap and the carrying case in a closed position.

22. The carrying case assembly of claim 1, wherein the carrying case further comprises: an attachment that enables fixable connection of a wire that extends from the carrying case to a retraction device on the user wearable strap, to restrict a distance from the user wearable strap from which the carrying case can be moved.

23. The carrying case assembly of claim 1, wherein the carrying case comprises one or more openings within the external casing to support access to corresponding one or more of input/output jacks, power ports, communication ports, user interface affordances, and a camera of the inserted personal electronic device while the inserted personal electronic device is located within the carrying case.

24. The carrying case assembly of claim 1, wherein the carrying case further comprises:

a folding flap having at least one segment that is extendable away from the carrying case to provide a pivot that enables the carrying case to stand in an upright orientation.

25. The carrying case assembly of claim 24, wherein the folding flap is configured with multiple movable parts that collapse to present a flat assembly adjacent to a surface of the carrying cases when the carrying case is not in an upright configuration.

26. The carrying case assembly of claim 1, wherein the user wearable strap is configured as a belt, wherein the user wearable strap comprises a loop of durable material that supports a weight of the carrying case with the portable electronic device inserted therein when the carrying case is attached to the user wearable strap by the interlocking mechanism.

27. The carrying case assembly of claim 1, wherein the user wearable strap further comprises a retraction component having a retraction mechanism and a wire connected at one end to the retraction mechanism and having a next end attached to the carrying case to enable restricted movement of the carrying case to a distance of a length of the wire away from the user wearable strap.

28. A carrying case comprising:

a compartment having an exterior casing and within which a first portable electronic device can be inserted for storage and use therein;

a fastener for securing the first portable electronic device within the compartment when the electronic device has been inserted in the compartment;

a first component of an interlocking mechanism attached to a top surface of the exterior casing in a vertically downward facing orientation and which enables the carrying case to be fixably attached to a user wearable strap via a second component of the interlocking mechanism that extends in a vertically upward position from the user wearable strap, the first component being a buckle having a female receptacle and a locking and unlocking mechanism; and the user wearable strap having the second component of the interlocking mechanism attached thereto, wherein the user wearable strap is designed to be worn around a torso of a user, and wherein, when the user wearable strap is being worn around the torso, a first segment of the second component is held in a rigidly upward position by a second segment in contact with the user wearable strap such that the first segment presents a male latching portion of the interlocking mechanism that extends in a vertically upward orientation to latch into the female receptacle of the buckle, wherein the second segment extends vertically upwards away from a first connecting end with the first segment and is connected at an opposing end to a third segment that extends vertically downward from the opposing end of the second segment, wherein the second and third segments attach the second component to the user wearable strap and holds the first segment rigidly vertically upwards such that the first segment extends in a vertically upward orientation away from the strap being worn around the torso of the user to enable vertical interlocking with the vertically downward facing female receptacle of the buckle;

wherein the buckle and latch assembly of the interlocking mechanism enables attaching, detaching, and hanging of the carrying case on the user wearable strap while the strap is being worn around the torso of the user, and wherein the buckle and latch mates together into a locked position when the first component is pressed down into mating contact with the first segment of the second component.

29. The carrying case of claim 28, further comprising:

a screen access surface within the exterior casing which provides viewable access to a screen of the inserted portable electronic device;

wherein the screen access surface includes an opening within the exterior case having a perimeter edge shaped to extend around a perimeter of the screen of the inserted portable electronic device;

wherein the screen access surface comprises a material that overlays and protects a surface of a screen of the inserted portable electronic device, wherein the material enables the screen access surface to transfer tactile inputs on an exterior surface of the material and transfer the tactile input to the screen of the portable electronic device and control the electronic device when the portable electronic device has a touch screen interface; and wherein the first component of the interlocking mechanism is located at a top of the carrying case with an orientation that enables the screen of the inserted electronic portable device to be oriented towards a body of a user wearing the carrying case assembly when the first component is interlocked with the second component.

30. The carrying case of claim 29, further comprising:

a cover flap that attaches to a perimeter of the screen access surface and is movable into one of (i) a closed position that covers and prevents access to the screen of the inserted portable electronic device and (ii) an open position that exposes the screen access surface;

wherein the cover flap is one of: (a) affixed at one end to a perimeter surface of the carrying case by a permanent adhesive means; (b) stitched at the one end to the perimeter surface of the carrying case; and (c) a separate component from the carrying case that is removably attached to the perimeter of the screen access surface via one or more non-permanent adhesive means; and wherein the cover flap includes one or more of the adhesive means at one or more perimeter surfaces of the cover flap and which enables the cover flap to be securely attached to an opposing perimeter surface of the screen access surface.

31. The carrying case of claim 28, further comprising:

an attachment that enables fixable connection of a wire that extends from the carrying case to a retraction device on the user wearable strap, to restrict a distance from the user wearable strap from which the carrying case can be moved; and one or more openings within the external casing to support access to corresponding one or more of input/output jacks, power ports, communication ports, user interface affordances, and a camera of the inserted personal electronic device while the inserted personal electronic device is located within the carrying case.

32. The carrying case of claim 28 wherein an angle of the buckle is adjustable to accommodate different orientations of the carrying case when attached to the wearable strap.

33. The carrying case of claim 28, wherein the carrying case further comprises:

a folding flap having at least one segment that is extendable away from the carrying case to provide a pivot that enables the carrying case to stand in an upright orientation, wherein the folding flap is configured with multiple movable parts that collapse to present a flat assembly adjacent to a surface of the carrying cases when the carrying case is not in an upright configuration.

34. The carrying case assembly of claim 1, wherein the user wearable strap comprises a belt that extends around a waist of a user wearing the carrying case assembly, wherein the belt is sized to accommodate being worn around the waist or the user and carrying at least the carrying case suspended downwards away from the belt and the interlocking mechanism.

* * * * *